US006260617B1

(12) United States Patent
Baugh et al.

(10) Patent No.: US 6,260,617 B1
(45) Date of Patent: Jul. 17, 2001

(54) SKATE APPARATUS FOR INJECTING TUBING DOWN PIPELINES

(75) Inventors: Benton F. Baugh, Houston, TX (US); James R. Crawford, Lafayette, LA (US)

(73) Assignee: Superior Energy Services, L.L.C., Harvey, LA (US)

( * ) Notice: Subject to any disclaimer, the term of this patent is extended or adjusted under 35 U.S.C. 154(b) by 0 days.

(21) Appl. No.: 09/185,989

(22) Filed: Nov. 4, 1998

Related U.S. Application Data

(60) Provisional application No. 60/067,503, filed on Dec. 4, 1997, and provisional application No. 60/066,380, filed on Nov. 21, 1997.

(51) Int. Cl.[7] ..... E21B 17/10

(52) U.S. Cl. ..... 166/241.3; 166/241.4; 166/241.6

(58) Field of Search ..... 166/312, 311, 166/383, 384, 77.3, 381, 241.1, 241.2, 241.3, 241.4, 241.6, 241.7; 405/154, 184; 175/325.1, 325.2, 325.3, 325.5, 325.6, 325.7; 254/389, 134.4; 226/196.1

(56) References Cited

U.S. PATENT DOCUMENTS

| | | | | |
|---|---|---|---|---|
| 712,486 | * | 11/1902 | Black | 166/241.3 |
| 712,487 | * | 11/1902 | Black | 166/241.3 |
| 712,488 | | 11/1902 | Black . | |
| 712,901 | * | 11/1902 | Black | 166/241.4 |
| 879,822 | * | 2/1908 | Karns | 175/325.3 |
| 1,281,756 | * | 10/1918 | Black | 166/241.3 |
| 1,801,294 | * | 4/1931 | Sutton | 166/241.3 |
| 2,887,118 | * | 5/1959 | Loeffler et al. | 134/112 |
| 3,056,155 | * | 10/1962 | Harmes | 15/104.06 |
| 3,089,434 | * | 5/1963 | Andreasen | 104/138 |
| 3,379,027 | * | 4/1968 | Mowell et al. | 405/154 X |
| 3,402,777 | * | 9/1968 | Watson | 173/147 |
| 3,467,196 | | 9/1969 | Kinsman et al. | 166/315 |
| 3,729,057 | * | 4/1973 | Werner | 175/325.2 X |
| 3,827,487 | | 8/1974 | Jackson et al. | 166/77 |
| 4,585,061 | | 4/1986 | Lyons et al. | 166/77 |
| 4,729,429 | | 3/1988 | Wittrisch | 166/65.1 |
| 4,852,391 | * | 8/1989 | Ruch et al. | 405/154 X |
| 4,941,773 | * | 7/1990 | Vergouw | 405/154 X |
| 5,188,174 | | 2/1993 | Anderson et al. | 166/77 |
| 5,309,990 | | 5/1994 | Lance | 166/77 |
| 5,309,993 | | 5/1994 | Coon et al. | 166/115 |
| 5,316,094 | | 5/1994 | Pringle | 175/74 |
| 5,355,950 | * | 10/1994 | Zwart | 166/241.6 |
| 5,429,194 | * | 7/1995 | Nice | 166/383 |
| 5,447,200 | | 9/1995 | Dedora et al. | 166/311 |
| 5,494,103 | | 2/1996 | Surjaatmadja et al. | 166/222 |
| 5,566,764 | | 10/1996 | Elliston | 166/385 |
| 5,692,563 | | 12/1997 | Krueger et al. | 166/85.5 |
| 5,695,009 | | 12/1997 | Hipp | 166/196 |
| 5,704,393 | | 1/1998 | Connell et al. | 137/614.21 |

FOREIGN PATENT DOCUMENTS

| | | | | |
|---|---|---|---|---|
| 0 187 599 | | 7/1986 | (EP) . | |
| 894117 | | 4/1962 | (GB) . | |
| 1132503 | | 11/1968 | (GB) . | |
| 402128094 A | * | 5/1990 | (JP) | 405/184 |
| 94/23174 | | 10/1994 | (WO) . | |
| 97/12116 | | 4/1997 | (WO) . | |

* cited by examiner

*Primary Examiner*—David Bagnell
*Assistant Examiner*—Sunil Singh
(74) *Attorney, Agent, or Firm*—Howrey Simon Arnold & White, LLP

(57) ABSTRACT

A method and apparatus which inserts and withdraws tubing from pipes without bending or kinking the tubing. The method and apparatus may be employed to insert and withdraw tubing to depths greater than ever possible before. The method involves using skate apparatuses to reduce coiling and friction of the tube. Advantageously, the apparatus is portable, easily handled, and adaptable to handle tubing of differing diameters.

9 Claims, 4 Drawing Sheets

SKATE APPARATUS FOR INJECTING TUBING DOWN PIPELINES

CROSS REFERENCE TO PATENTS

This application claims priority from provisional patent application Ser. No. 60/066,380 filed on Nov. 21, 1997, entitled "Method and Apparatus of Injecting Coil Tubing Down Pipelines", and provisional patent application Ser. No. 60/067,503 filed on Dec. 4, 1997, entitled "Method and Apparatus of Injecting Coil Tubing Down Pipelines".

FIELD OF THE INVENTION

The instant invention relates to a method and apparatus of injecting tubing down a pipe or open hole. In particular, the instant invention relates to a method and apparatus of injecting coiled tubing down a pipe in deep water to provide servicing of the pipe to remove paraffinic blockages, hydrates, scale, or solid debris from the pipe. More particularly, the instant invention relates to a method and apparatus of injecting tubing into a pipe, wherein a substantial portion of the pipe is horizontal.

BACKGROUND OF THE INVENTION

In the development and production of subterranean hydrocarbon deposits and other energy sources there are many occasions when it is necessary to insert an elongated tube from the surface deep into a pipe or open hole. Such pipes or holes may be vertical, horizontal, curved or combinations thereof and may be part of, for example, a well, pipe line, production line, or drill pipe. The inserted tube has an outer diameter that is smaller than the inner diameter of the pipe or open hole. The insertion of the tube may be for such purposes as, for example, removing blockages or general servicing.

Often during repair or servicing of a pipe a rig capable of handling long lengths of straight screw-type pipes is not available. In many cases the strength of larger diameter straight screwed tubing is not needed, so the cost of running this type of tube is not justifiable. In these cases it is often advantageous to use a long, continuous injected tubing called coiled tubing. Many apparatus have been developed to insert or inject a continuous length of relatively thin walled steel tubing into a pipe or open hole from a large reel or spool on the surface.

Large forces are often necessary to insert and withdraw thousands of feet or more of steel tubing into a pipe or open hole which may be filled with hydrocarbons or other materials. Most apparatuses developed heretofore have focused on the injector head located where the smaller tubing is injected into the larger tubing. The injector head grips the tubing along its length and, in conjunction with a motor, guides and forces the tubing into the pipe via, for example, a dual, opposed conveyor belt on the surface of the well. Typical injector heads are described in, for example, U.S. Pat. No. 3,827,487; 5,309,990; 4,585,061; 5,566,764; and 5,188,174 which are incorporated herein by reference.

Unfortunately, the apparatuses of these patents are problematic in many respects. One such problem is that the tubing may be bent or kinked, i.e., the tubing becomes helical, down the well due to the large forces pushing against it and the weight of the tubing itself. This is especially problematic when the pipe is deviated from vertical. As the pipe becomes more horizontal, the weight of the coiled tubing itself no longer acts as a force pulling the tubing along, and instead acts against the wall of the pipe, creating friction. In addition, the weight of the tube no longer acts to straighten the coiled tubing, and the coil encourages coiling in the pipe. Such a coil, coupled with friction, results in increased force between the coiled tube and the inner diameter of the pipe, and this effectively binds the tubing. As a result of this and other problems, such prior art devices cannot effectively insert more than about 3,000 to about 5,000 feet (900 to 1500 meters) of tubing in substantially horizontal pipe.

Another typical problem with prior art devices is that the injector equipment associated with such devices is often relatively heavy, difficult to move, and complex due to a large chain assembly machinery which serves as a conveyor belt to force the tubing into the pipe.

Other methods have been employed to increase the length to which tubing can be injected. U.S. Pat. No. 5,704,393 describes an apparatus that can be set in the well at the end of the coiled tubing string at a determinable location. The apparatus is a valve apparatus, a packer apparatus, and a connector. Seals are provided which allows the coiled tubing, but not fluid, to move in a centrally located bore through the packer apparatus. The apparatus is immobile against the outer pipeline, and has the ability restrict or prevent fluid flow. Once the packer is set, the annular pressure , i.e., the pressure differential between the pipeline and the interior of the coiled tubing, is increased by injecting fluid into the annular volume. This increased pressure stiffens and straightens the coiled tubing, allowing for increased distance of injection of coiled tubing into the pipeline.

One method of reducing friction in injected tubing is the tubing friction reducer described in U.S. Pat. No. 5,692,563. This patent describes a friction reducer that contains multiple bearings set in legs that extend outward from a body. The friction reducers described by the patent did not have the mechanical integrity needed to support the weight of larger diameter tubing. Applicant also found that the design of the friction reducers described therein could not be used in field conditions where obstructions in the pipeline are common.

It is apparent that what is needed in the art is a method and apparatus which allows one to readily insert and withdraw tubing from a pipe for long distances, i.e., greater than about 6,000 feet (1830 meters), without bending or kinking the tubing. It would be beneficial if such a method and apparatus could be employed to insert and withdraw tubing from a substantially horizontal pipe of extended length of greater than 6,000 feet (1830 meters), and that the tubing can extend past turns. Moreover, it would be of great benefit if such an apparatus was portable, easily handled, and could be adapted to handle tubing of differing diameters.

SUMMARY OF THE INVENTION

A new method and apparatus have been developed which inserts and withdraws tubing from pipes or open holes. Beneficially, the new method and apparatus may be employed to insert and withdraw tubing to lengths of over 6000 feet (1830 meters), preferably greater than 26,000 feet (9900 meters), and more preferably greater than 60,000 feet (18,300 meters). Advantageously, the apparatus is portable, easily handled, and adaptable to handle tubing of differing diameters.

The instant invention comprises a skate apparatus for attachment onto the outer diameter of injected tubing. The skate apparatus has a body diameter greater than the diameter of the injected tubing, and has a cylindrical port capable of fitting around a portion of the injected tubing. The body is openable lengthwise by a width sufficient to insert the injected tubing. This allows the skate apparatus to securely fit around the outer diameter of the injected tubing. There is a means of fastening the skate apparatus to the outer diameter of the injected tube. Finally, there is a set of three to six, preferably three to four, rigid arms extending in a plane in a direction toward the interior surface of the pipe, wherein each of said arms contains one or more wheels on the distal end of the arms. By in a plane it is meant that there is a cross-section of the skate that will include at least a portion of the three to four arms that radiate out from the body. There may be more than one set of three to four arms on a body, provided the sets are displaced axially along the body from one another.

The wheels are capable of movable communication with the inner surface of said pipe. The radius from the center of the injected tubing to the outermost edge of the wheels or rollers is not smaller than 0.5 times the radius of the pipe. This skate apparatus maintains a portion of the tubing in the center of the pipe such that the movement-restricting force for at least a portion of the injected tubing is rolling friction rather than a combination of sliding friction and the force needed to overcome the shear viscosity of the fluid within the pipe.

DETAILED DESCRIPTION OF THE INVENTION

Figure 1:
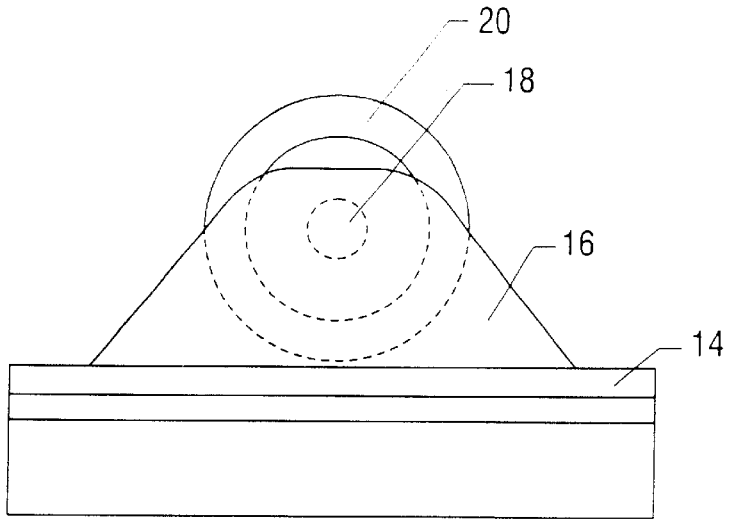
FIG. 1 is a diagram of a arm and wheel on a skate apparatus. The wheel 20 is attached to the preferably beveled arm 16 with an axle 18. The three arms, only one of which is shown, are attached to the cylindrical body 14 in a plane. The dimensions of the arms are not critical, but an arm such as shown will not tend to become stuck by obstructions in the pipe while traveling in a forward or reverse direction.
Figure 2:
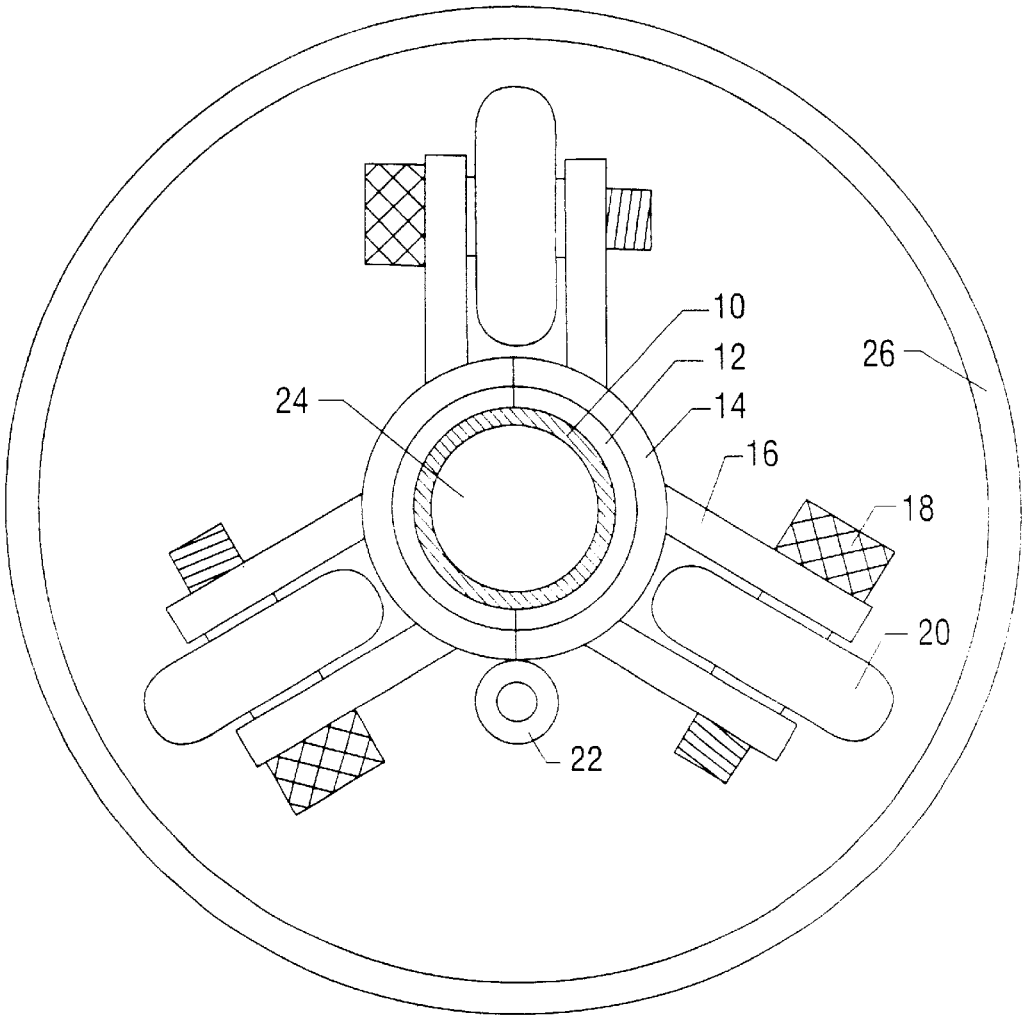
FIG. 2 is a diagram of an exemplary skate apparatus from a front-on view. The injected tubing 10 has an annulus 24 wherein fluid can be transported. The skate assembly has an optional sleeve 12 that allows the skate apparatus to be installed on injected tubing that is smaller than the design parameter for the skate apparatus. The cylindrical body 14 has a hinge assembly 22 and an attaching means whereby the skate apparatus is firmly secured about the injected tubing 10. In this case, the attaching means is the axle for the wheel directly opposite the hinge assembly. The three rigid arms 16 extend radially toward the pipe 26 in a plane perpendicular to the line formed by the injected tube, though the arms need only extend outward, and need not be radial from the center of the injected tubing. The axle 18 holds the wheels 20. There may be more than one set of three or four arms and wheels on a skate apparatus if the additional set or sets are further on a different cross-section of the cylindrical body.

As used herein, the term "injected tubing" includes tubing or screwed pipe injected into other pipe. The coiled tubing or pipe may be of any diameter such as 1 inch, 1.25 inch, 1.5 inc., 1.75 inch, 2 inch, 2.375 inch or greater. The size of the coiled tubing or pipe is determined by the size of the pipe line or wellbore and the purpose for inserting the tubing. Several reels of coiled tubing may be joined together to inject to greater lengths than a single reel can reach. The coiled tubing reels can be connected not only to provide a continuous string of tubing for extended reach service, but to help over some weight restrictions they may be encounter or some locations, where it would be impossible to lift a reel of pipe with more than 50,000 foot of pipe on it. These reels are connected by methods known to the art. The injected tubing may be coiled or jointed pipe, i.e., straight pipe joined by, for example, standard oil field threaded unions such as CS Hydril. The injected tubing may be joints of traditional tubing used in oilfield drilling and production operations, such as 2.375 inch nominal outer diameter tubing.

As used herein, the term "pipe" includes any steel or other pipe or tubing into which the injected tubing passes. While pipes and open holes may be any shape, typically, they are substantially cylindrical. As a practical matter, the pipe can be 2 inch to about 24 inch or greater nominal outer diameter pipe. Said pipe may be threaded or welded. A portion of said pipe is partially horizontal. Said pipe may be a wellbore.

As used herein, the term "partially horizontal" includes pipe or continuous tubing or pipe and open hole, in which a fraction of the pipe or tubing has a vertical rise over run of about 0.6 or less measured in the direction so that both rise and run are positive units of length. Said pipe may include sections in which the rise over run is greater than 0.6 and may include turns.

A new method and apparatus have been developed which inserts and withdraws tubing from pipes or open holes without bending or kinking the tubing. Beneficially, the new method and apparatus may be employed to insert and withdraw tubing to lengths of over 6000 feet, preferably over 26,000 and more preferably over 60,000 feet. Advantageously, the apparatus is portable, easily handled, and adaptable to handle tubing of differing diameters. The apparatus consists of skate apparatus, a thruster pig, or both. The method involves attaching the thruster pig to the distal end of the injected tubing, and then injecting this tubing into the pipe using pressure exerted against the back of the thruster pig to provide at least a fraction of the force needed to inject the tubing. One or more skate apparatuses are placed at predetermined intervals along the injected tubing.

The instant invention comprises a skate apparatus for attachment onto the outer diameter of injected tubing. The skates are advantageously spaced throughout the length of the injected tubing at predetermined intervals. The first invention is a skate apparatus is attached to the outside of coiled tubing to reduce friction. This device is formed to fit around the external surface of the tubing and to be firmly fixed thereon. The pipes may be oriented vertically, horizontally, curved or a combination thereof. Necessarily, the injected tubing and skates are each able to fit within the pipes to which they are to be inserted. The skates may be either integral to the tubing or separate from, but attached, to said tubing. It is preferable that the skates be readily both separate from the tube and removable. In this manner, the tubing may be easily coiled and stored on large reels or spools which are readily transportable. Moreover, the skates may be removed from tubing that has been employed in one application and installed upon tubing, perhaps of a different size, which is to be employed in another application.

The skate apparatus has a body of diameter greater than the diameter of the injected tubing, having an interior cylindrical port adapted to fit securely around the a portion of the injected tubing. The body may be separable into one or more parts when not secured to the injected tubing. The exterior dimensions and appearance of the body are not important. The cylindrical port interior surface allows the skate apparatus to securely fit around the outer diameter of the injected tubing. The skate apparatus is openable so that it can be added to injected tubing by clamping the skate apparatus to the tubing. This operation is usually performed below the conventional injector head so that the skate apparatus need not pass through the injector head. This necessarily means the body must be openable length-wise so that it can the injected tubing can be inserted into the port. The cylindrical body must also have a means of fastening the skate apparatus to the outer diameter of the injected tube. This can be one or more hinges and clamps, or hinges and bolts, or clamps, or bolts, or other connecting mechanisms know to the art. When attached, the cylindrical port applies a compressive force which holds the skate apparatus in place on the tubing.

One method of reducing friction in injected tubing is the tubing friction reducer described in U.S. Pat. No. 5,692,563. This patent describes a friction reducer that contains multiple bearings set in legs that extend outward from a body. The patent specifies that bearings of about 0.2188 inches in diameter can be used. Use of such a bearing would give a clearance of about 0.1 inches of less between the tip of the bearing and the holding leg. In addition, this patent described friction reducing devices with 12 or more rows of wheels. Applicants found that, when there are obstructions in the line, having only three or four legs, plus the additional clearance given by larger wheels, allowed the skate apparatus to pass over the obstruction. Applicants found a skate apparatus with three legs was preferable to an apparatus with four legs. Finally, the applicants noted that the described friction reducer embodiments were not applicable for larger diameter coiled tubing, in that the designs did not have the mechanical strength needed to support tubing. For example, the patent states that the friction reducer could be made of a metal such as aluminum, plastic, rubber, or other composites, and the ball bearings in one embodiment are of Teflon. Applicants found that molded steel bodies with a minimum number of welds were necessary to circumvent tight turns in a pipe without breaking. Applicants found certain very durable composites, such as polysulfone, could be used as wheel material only for very light service. For normal service, steel wheels are required. Finally, applicants found that sludge and oil in a pipeline would freeze the bearings described in the '563 patent. Conventional testing assumes a relative high contact stress with the oil lubricity assisting, but with the oil viscosity as a non-factor. In the lowloading characteristics of coiled tubing, the viscosity can be a factor several times that of friction. Therefore, the devices described in U.S. Pat. No. 5,692,563 were not deemed operable for heavier coiled tubing or for pipe with obstructions.

There are three to six, preferably three to four, more preferably three, rigid arms extending as a set from the cylindrical body in a direction toward the interior surface of the pipe. The set of arms are in a plane perpendicular to the cylindrical body. There may be more than one set of arms on a skate apparatus. Each of said arms contains one or more, preferably one or two, wheels on the distal end of the arms. The skate apparatus must fit into the pipe. The radius from the center of the injected tubing to the outermost edge of the wheels or rollers is preferably between about 0.50 to about 0.95 times the radius of the pipe, and more preferably between about 0.8 to about 0.9 times the radius of the pipe. This skate apparatus maintains a portion of the tubing in the center of the pipe such that the movement-restricting force for at least a portion of the injected tubing is rolling friction rather than a combination of sliding friction and the force needed to overcome the shear viscosity of the fluid within the pipe.

The device may contain a plurality of sets of arms extending generally outward from the tubing and toward the internal surface of the pipeline. Each set of arms must be in a different cross-section of the cylindrical body. Having only 3 or 4 arms in a plane facilitates the skate moving over obstructions in the pipe. A skate apparatus with three arms was found to be preferable at moving past obstacles than is a skate apparatus that contains four arms in a plane. A skate having one or two sets of arms in a plane is preferred over a skate with three or more sets of arms in a plane, because the latter are more prone to hanging up on obstructions in the pipe.

One or more, preferably one, wheel or wheels are attached to the outward-most ends of each of the arms. The wheels have the capability of engaging the inner surface of the pipeline, and to move relative to the internal surface of the pipeline, thereby reducing friction between the tubing/skate assembly and the pipeline below that which would be generated between the tubing and the pipeline. The wheels are capable of movable communication with the inner surface of said pipe, and are oriented to move by rolling in a direction parallel to the pipe. The specific design of the skates to be employed is not particularly important so long as the skates attach firmly to the tubing to be inserted. It is also important that the skates be designed so that at least one, preferably at least two wheels of the skates are in movable communication with the inner walls of the pipe as the tubing is being inserted or withdrawn from the pipes. By "movable communication," it is meant that the wheel and inner wall of the pipe are in contact such that the one or more wheels rotates clockwise as the tubing is being inserted and counterclockwise as the tubing is being withdrawn.

The materials of which the wheels of the skates are made should be those which allow the wheels to readily turn when in contact with the inner diameter of the pipes in order to facilitate the insertion and withdrawal of the tubing. The composition of the wheels is preferably steel or, for less severe service, the wheels can be polysulfone-based composite. The wheels may wear quickly in severe use, so it is advantageous to have the wheel be readily removable and changeable. The wheels may be curved or beveled on the outer face that contacts the pipe, with the radius of curvature or the bevel intended to match the curvature of the pipe. The wheels are preferably large, for example with a radius of at least one half the radius of the injected tubing.

It also may be desirable to lubricate the wheels at the axles to facilitate rotation. It may also be desirable to have bearings or other friction-reducing devices in the wheels, axle, or arms, as appropriate. In a preferred embodiment, sealed bearings are installed on each set of wheels to reduce friction.

While not wishing to bound to any particular theory, it is believed that the wheel or wheels of the skates acts to facilitate the insertion or withdrawal of the tubing in a number of ways. One way the skates facilitate the entry and withdrawal is by supporting the tubing in order that the tubing does not get caught on items within the pipe such as pipe connectors or other solids or obstructions which may be on the inside diameter of the pipes. Rather, the wheels allow the tubing to readily roll over such obstructions. Moreover, by holding the tubing well away from the wall the shear viscosity of the liquid at the pipe/tubing interface is not important. Moreover, the skates prevent helical coiling and buckling of the tubing due to frictional resistance encountered when large lengths of tubing are moved into and out of a pipe. Finally, the rolling resistance of the wheels is less than the frictional resistance of the tubing sliding against either the pipe or on a film of solid or fluid within the pipe.

Figure 3:
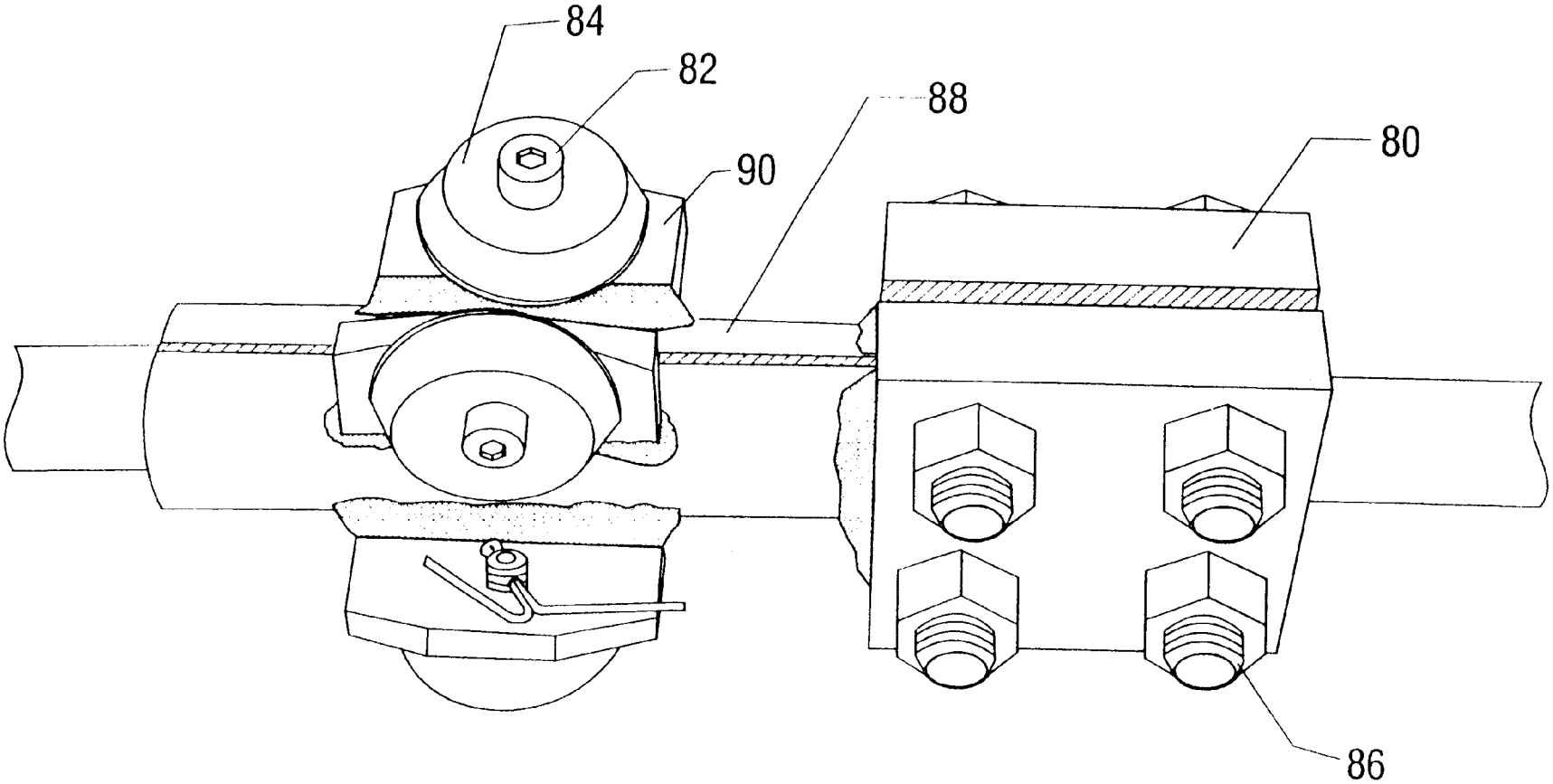
FIG. 3 and FIG. 4 are another embodiment of the skate apparatus. This skate has a attaching or gripping means 80 that is comprised of two blocks with semicircular channels cut therethrough, adapted to fit securely around tubing. The two blocks fit around the tubing, and are secured by four bolts 86. The blocks are integral with a body 88, that is in two pieces and is inherently slightly flexible. The body 88 that holds the legs 90. There are four legs 90 that are attached so that the legs are skewed from radial, but the legs nevertheless extend out toward the inner surface of the pipe. The four legs support one wheel 84 per leg, said wheel being connected to said leg by an axle 82.
Figure 4:
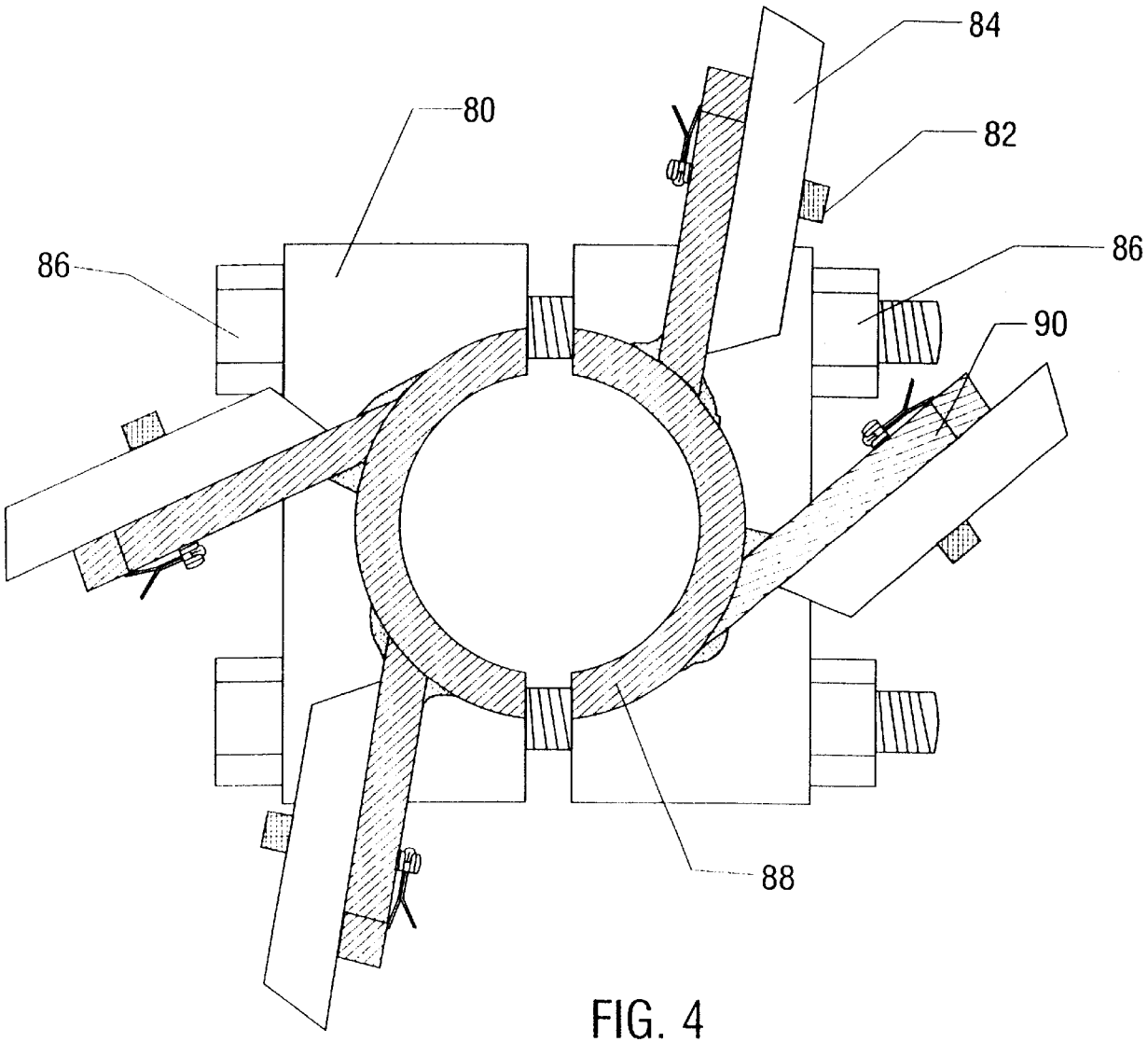
Figure 5:
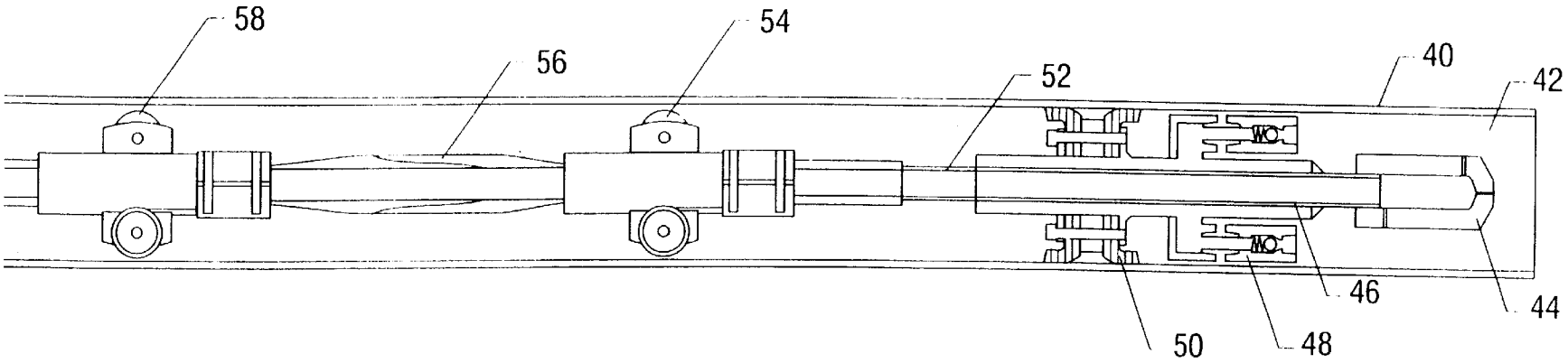
FIG. 5 is an embodiment of the skate apparatus in use with other tools, including a thruster pig. The thruster pig 46 is comprised of chevrons or cups 50 that seal against the pipe 40. The thruster pig contains a plurality, preferably four, check valves 48. One which can be used to equalize the hydrostatic force on the thruster pig as it is pulled back out of the well or pipe line. The check valves also allow fluid that may be pumped down the injected tubing 52 and through the nozzle head 44 to flow back up the annulus. Two skate apparatuses 54 and 58 are positioned on either side of a standard coupling/fishing hook. Other skate apparatuses are beneficially in place at predetermined intervals on the injected pipe. In the event the thruster pig becomes stuck, a ball injected down the injected tubing can release the fishing neck 56, which can be male or female, and the thin walled injected tubing and skate 58 can be withdrawn. Then, larger or more strong tubing or a fishing neck can be injected into the pipe, can mate and attach to the fishing neck 56, and can exert a greater pulling force than could be generated with typical injected tubing.

One preferred embodiment is that shown in FIG. 3. The attaching means is axially displaced from the body where the legs are attached. The attaching means is two sections adapted to grip the tubing, and the two sections are heal together by a plurality of bolts or, alternatively, at least one hinge and at least one bolt. The legs extend outward from the body, but at an angle near perpendicular, say between 60 degrees and 120 degrees, to the radius of the tubing. The legs, and therefore the mounted wheels, are therefore skewed from radial. This allows the wheels to be conveniently changed to accommodate different pipe sizes. It is preferred that the axle be positioned so that wheels varying by at least 30 percent in radius or diameter can be installed on the leg, and the wheels still support the legs from contacting the tubing. The wheels are beneficially beveled to match the interior of the pipe against which the wheels move. It is often advantageous to have the largest wheels practicable, both so that the tubing is kept more toward the center of the pipe and so that small obstructions in the pipe do not hang up the body. If the legs and wheels are radial, there is less flexibility on wheel size selection. The wheels are preferably large, for example with a radius of at least one half the radius of the injected tubing. It is often preferred, especially for older pipes that contain obstructions, that the wheels have a diameter greater than, and often several times greater than, the diameter of the injected tubing. The body is preferably slightly flexible, that is, able to flex at least about 4 degrees, in response to obstructions and curves in the pipeline. Said slight flexibility is strong enough to support said tubing but flexible enough to adapt to the large forces generated in inserting a tube past an obstruction or around a curve.

The instant invention employs one or more skates to assist the insertion and withdrawal of tubing into a pipe.

A port capable of accepting tubing is located at the center of the skate apparatus. The port may be made adjustable such that tubing of various diameters may be inserted and securely held therein. Particularly preferred diameters of injected coiled tubing are 1 inch, 1.25 inch, 1.5 inch, 1.75 inch, 2 inch, 2.375 inch, 2.75 inch, or greater nominal outer diameter.

Once the tubing is inserted into the cylindrical port, the port is adjusted until the tubing is held firmly in the skate. The adjustment may be by the same clamp or bolts used to close and secure the cylindrical body. The clamping and holding portion of the skate apparatus may be on one end of the skate apparatus, with the arms and wheels are on the other end of the skate apparatus. This allows the device to be secured and bolted with less possibility of damage to the arms and wheels. In one embodiment, the axles also serve as securing bolts for the skate apparatus.

Advantageously, an adapter grip spool that fits securely inside the cylindrical body can be utilized when the diameter of the injected tubing is smaller than the diameter of the interior of the cylindrical body. Using such adapter grip spools allows a skate assembly designed for 1.25 inch tubing to be used with, for example, 1 inch tubing.

Advantageously, the axles of the skate may be shortened or lengthened and the angles may be varied depending upon the diameter of the pipe to which the tubing is to be inserted and the application for which the skate is to be employed. It is usually preferable to have multiple skate assemblies of various sizes. However, an extension cover that fits securely over the skate, and that has 3 or 4 arms and one or more wheels on the distal end of each of the arms, that extend the reach of the arms, can be used under certain circumstances.

The materials of which the skates are comprised are not critical so long as the skates are able to withstand the conditions to which they are to be subjected within the pipe. Often such conditions may include extreme temperatures, pressures, as well as, corrosive chemicals. In addition, there is a large amount of stress on the skates when the skates are supporting long lengths of injected tubing.

The instant invention can be used with a thruster pig that utilizes a pressure differential to pull injected tubing down a pipeline. The thruster apparatus comprises a tool which is capable of being attached to or is integral with the end of the tubing to be inserted into the pipe. The thruster pig device is firmly attached to the injected tubing, and is as a practical matter the thruster pig is usually attached at or near the distal end, i.e., the injected end, of the tubing. The thruster pig may, under certain circumstances, be advantageously placed further back on the injected tubing. There may be occasions where more than one thruster pig is attached to a line.

The attachment may be by any conventional method. One preferred method is to use standard releasing subs, known in the art, which allows the thruster pig to be released by pumping a ball down the injected tubing. The attachment point may also contain a hinge, ball joint, or swivel joint which allows the thruster pig to more easily orient itself in the pipe.

The diameter of the thruster pig in some plane is about the same diameter as the interior of the pipeline. The body of the thruster pig has a outer diameter greater than the outer diameter of the injected tubing and equal to or smaller than the inner diameter of the pipe. The shape of the thruster pig is not important, so long as the thruster pig makes essentially a fluid-tight seal between the injected tubing and pipe. As used herein, the term "essentially fluid-tight seal" means the device is a substantial restriction to flow of fluids between the injected tubing and the pipe. Pressure is usually supplied by a pump, and the thruster pig will remain operable so long as the restriction to flow is sufficient to allow the pump to increase the pressure in the annulus to the desired level.

The thruster pig is able to move relative to the internal surface of the pipeline. Pressure is applied to the back of the pig. The thruster pig has a sealing apparatus, for example one or more chevrons, to impede fluid migration between the body of the thruster pig and the inner surface of the pipe. This effectively creates an annulus between the injected tubing and the pipe so that pressure can be applied to the rear of the thruster pig. Seals prevent substantial quantities of fluids from flowing between either the tubing and the thruster pig and between the thruster pig and the interior surface of the pipeline. The seal between the injected tubing and the thruster pig can be a metal weld, a screw type seal, a compression type seal, or any other seal known to the art. The thruster pig is adapted to form a seal to the interior surface of the pipe. The seals can be any type of seal, including extrusions, cups, chevrons, disks, or a combination thereof. The seal or seals are preferably cups as depicted in FIG. 3 and as are used in the art for pipeline pigs. The material of the seals is advantageously elastic so that it can move past obstructions in the pipeline while maintaining some sealing capability, and then re-forming an essentially fluid-tight seal after passing the obstruction.

A bore through the thruster pig allows fluid to be injected through the injected tubing and through the thruster pig into the pipeline ahead of the thruster pig. This bore may contain the injected tube, or it may be a continuation of that flow path. When the thruster pig is moving forward, fluid may be withdrawn from the volume ahead of the pig through this aperture.

Depending on the application, many different tools may be attached to the thruster apparatus. Tools are generally attached to the front of the thruster pig. A high pressure nozzle, wash or jet tool, drills, hammers, and other oil field tools may be attached to the end of the coiled tubing extended reach system to help remove, paraffin, scale, hydrates, sand or other debris as may be encountered. For instance, if cleaning of the pipe is necessary, a jet washer tool which sprays water or other chemicals at the walls of the pipe may be attached. A brush-type tool may also be attached to the pig. Likewise, if the pipe is blocked by, for example, solid or waxy deposits, then a tool which is capable of removing the blockage, for example a high pressure nozzle, may be employed. Fluids then can be pumped down the injection tube and out, at high velocity, through the high pressure nozzle or apparatus. Another embodiment is a jet nozzle which does not sweep the bore ahead of the end of the coiled tubing string, but focuses a nozzle on the center of the bore ahead to melt deposits with a minor amount of flow, and the majority of the flow is in the reverse direction to push minor amount of trash backwards in a diluted form.

The pumped fluids can be of any conventional type, such as acids, chemicals, lubricating fluids, solvents, surfactants, water, alcohol, and the like. Beneficially, the sealing means should be compatible with the injected fluid.

The thruster apparatus advantageously has one or more valves, in series or in parallel, which allows the user to pumped fluids to pass through the thruster pig to the annulus behind the thruster pig. These valves are often check valves. The check valves are designed to let the fluids injected down the tubing to circulate through the annulus and out of the pipe. The check valves are actuated by pressure ahead of the thruster pig being higher than pressure behind the thruster pig.

In one embodiment of the invention, a plurality of check valves or other valves are present that allow flow in each direction. Those check valves that allow pumped fluid to circulate are actuated by pressure differential across the thruster pig, and the actuation pressure is very low, for example between 0.5 and 100 pounds per square inch. These valves are only activated, however, when pressure ahead of the thruster pig exceeds the pressure behind the thruster pig. A second set of valves or check valves allows fluids under some conditions to flow from the annulus between the tubing and the interior surface of the pipe to the front of the pig. These check valves may be actuated by higher pressure differentials, for example by 50 to about 400 psi, across the thruster pig. These check valves are limits on the pressure that can be exerted against the back of the thruster pig during injection, as they will open and allow fluid to pass. These valves may be activated by any other mechanism known to the art, including electric switches, a second injected control tubing, or an injected ball, or the like. These valves are advantageously open when the thruster pig is being withdrawn, so that any fluids that are behind the thruster pig can move to the front of the thruster pig, and therefore need not be swabbed from the well.

In one embodiment of the invention, a plurality of thruster pigs are attached on the injected tubing, either closely spaced or not closely spaced. Check valves that allow fluid to flow from behind the thruster pigs to the front of the thruster pigs are pressure activated, and therefore limit the pressure differential, and the thrust developed by each pig.

It is advantageous that the releasing sub or other connecting means have a stabilizer so that if the thruster pig is left in the pipe after withdrawing the injected tube, then going to retrieve the thruster pig with a fishing operation will be facilitated. The centralizer can be a skate apparatus.

The instant invention also is a method for injecting tubing for long distances into a pipe. This method comprises feeding the injected tubing, preferably coiled tubing, into a pipe which has a larger diameter than said coil tubing. The injected tubing has a thruster pig located at or near the distal end of the injected tubing. By near to the distal end, it is envisioned that at least one thruster pig would be located within about 5000 feet, more preferably within about 1000 feet, of the end of the injected tube. One reason it may be advantageous to connect a thruster pig back from the end of the tubing may be that there is an obstruction in the pipe that the thruster pig can not get past and can not remove, and the tubing must be injected past that obstruction. The injected tubing also has one or more skate apparatuses which are attached to said tubing at predetermined intervals. After the thruster pig is inside the pipe, at least a portion of the force needed to inject the tubing into the pipe is provided by pressure exerted on the annulus. A portion of the force may in some circumstances also be beneficially provided by the injector head.

As the injected tubing is injected into the pipe, skates are attached at predetermined intervals. Given the disclosure of this application, one skilled in the art would be able to calculate the maximum space between skate apparatuses for a given set of conditions. The skate apparatuses are beneficially attached to the injected tubing below the injector head. Use of secure yet easy to apply connecting and securing means is therefore important.

The two components can be combined with multiple reels of coiled tubing, with appropriate tubing-to-tubing connectors, and the combination will allow multiple reels of coiled tubing to be injected into the well or pipeline, and to be recovered therefrom. In the event the injected tubing requirements would be for more than 15,000 feet, or their is a weight restriction due to the crane size or an offshore or inland platform, more than one spool of pipe can be connected below the injector head. The connection can be by any means known to the art. However, it is beneficial to have one or more skate apparatus near to or integral with the connecting means.

The instant invention also is a method for withdrawing said injected tubing from the pipe, said method comprising opening a normally closed aperture through the body of the thruster pig, said aperture allowing fluid migration from the annulus to the pipe that is ahead of the thruster pig. Optionally, pressure may be exerted through the injected tubing to the pipe ahead of the thruster pig, said pressure being greater than the pressure in the annulus behind the thruster pig, thereby providing a portion of the force needed to withdraw the injected tubing from the pipe. The thruster pig can, with the appropriate pressure differential, apply 30,000 pounds or more of thrust. This pressure which creates the force may be limited by the check valves that allow fluid circulation, or by the mechanical strength of the tubing or thruster pig.

Finally, it may be beneficial to pump off the thruster pig that is connected to the injected tubing by releasing subs. The releasing sub may trap the ball, thereby closing off the bore in the thruster pig. The thruster pig can then be forced ahead through the pipe until a location is reached where the pig can be removed. This will sweep debris ahead of the pig, cleaning the pipe. The injected tubing is withdrawn without the thruster pig.

The tubing, with the skates either integral with or attached to it, may be inserted into and withdrawn from a pipe by any means. Generally, the means employed is dependent upon the length of tubing to be inserted, as well as, the design of the pipe, i.e., straight, curved, right angle bends, etc. In most instances, the longer the tubing and the more the pipe is curved or bent, the more force that may be required to insert the tubing in the pipe.

It may sometimes be desirable to include a coupling tool or a pipe connector for attaching check valves, thruster pigs, multiple thruster pigs, release subs, and connecting one or more reels of coiled tubing together. The combination of tools and the spacing will be obvious to one skilled in the art given the disclosure herein.

EXAMPLE

A test facility to simulate 5 miles extended reach in degree of difficulty was built of 6⅝" outer diameter pipe. The test facility had about 900 feet of pipe in a horizontal plane sloping downwardly at 1/16" per foot. There were four 90 degree turns with a radius of 25 feet. The pipeline was confirmed to be equal in difficulty to a five mile pipeline in that standard coiled tubing could not be pushed through the pipeline, but would instead helically buckle and lock itself from moving further into the pipeline.

A paraffin plug was formed at the end of the pipeline opposite to where the coiled tubing was injected.

The skate apparatuses used were similar to those shown in FIG. 3. One skate was placed at the end of the injected coiled tubing approximately one foot from a high pressure jet tool which was adapted to spray straight ahead, as well as, sideways to clean the pipe. A second skate was placed 25 feet from the first skate and a third skate was placed 50 feet from the second skate. Seven more skates were placed on the tubing at intervals of 100 feet. The coiled tubing was thrust into the pipeline and drag was measured every 200 feet. The injector head had a counterbalance (safety) valve which required 250 psi. to open it and allow the injector head to start moving. During operations of moving a string of coiled tubing to the wax plug, the required pressure did not exceed the 250 psi. of the counterbalance valve at running speeds up to 45 feet/minute. The coiled tubing moved smoothly into the pipeline until the wax plug was encountered and the movement stopped.

EXAMPLE

A four inch pipeline that had been shut in for many years was selected to test the skate apparatus. The pipeline had an obstruction at a distance of about 1 mile. The injected tubing was 1.25 inch coiled tubing. There were 2 turns, forming an "S" curve, with a turning radius of about 26 inches just below the work desk. The thrust required to inject the tubing past this "S" curve was 2300 pounds. The coiled tubing was injected until the obstruction was encountered at 1 mile. The coiled tubing was then alternately run back and forth from the "S" curve to the obstruction until the installed skate apparatuses had about 50,000 feet of total running distance. The skates showed no signs of failure. The coiled tubing was removed and injected without skates. The friction drag without skate apparatuses was 0.42 pounds per foot. The friction drag with skate apparatuses was 0.19 pounds per foot.

What is claimed is:

1. A skate apparatus used to facilitate injecting tubing into a first pipe, said skate apparatus comprising:

(a) a first section for gripping the outer surface of said tubing with a cylindrical port for receiving a portion of the tubing;

(b) a second section comprising a body and a first set wheels mounted on legs with axles, said body connected with said first section and said legs, each wheel from said first set of wheels extending outwardly from said body in a direction toward the interior surface of the first pipe, said wheels mounted in a position skewed to a line radial to the centerline of said tubing, said wheels for contacting and being in moveable communication with the inner surface of said first pipe to support a portion of said tubing against contact with the inner surface of said first pipe, wherein the radius from the center of the injected tubing to the outermost edge of the wheels is less than the inner radius of the first pipe, and said axles being removable from said legs and said wheels.

2. The skate apparatus of claim 1 wherein there are four of said legs with each leg having a wheel.

3. The skate apparatus of claim 1 wherein there are three of said legs with each leg having a wheel.

4. The skate apparatus of claim 1 wherein the first section for gripping the outer surface of said tubing comprises two sections adapted to fit around the tubing, and bolts joining the two sections.

5. The skate apparatus of claim 1 wherein said first set of wheels are able to be exchanged for a second set of wheels of an outer diameter at least 20% different than the outer diameter of said first set of wheels by removing said axles, said second set of wheels to support said tubing against contact with the wall of a second pipe of a different size than said first pipe.

6. The skate apparatus of claim 5 wherein said second set of wheels are beveled to match the interior of the second pipe against which the wheels move.

7. The skate apparatus of claim 3 wherein the body between said first section and said legs is a flexible material to allow said second set of wheels to pass obstructions in said second pipe.

8. The skate apparatus of claim 1 wherein said first set of wheels are beveled to match the interior of the first pipe against which the wheels move.

9. The skate apparatus of claim 1 wherein the body between said first section and said legs is a flexible material to allow said first set of wheels to pass obstructions in said first pipe.

* * * * *